US009175237B2

(12) United States Patent
Verlinde

(10) Patent No.: US 9,175,237 B2
(45) Date of Patent: Nov. 3, 2015

(54) TRUNK PISTON ENGINE LUBRICATING OIL COMPOSITIONS

(75) Inventor: Marcel Verlinde, Lage Zwaluwe (NL)

(73) Assignee: CHEVRON ORONITE TECHNOLOGY B.V., Rotterdam (NL)

( * ) Notice: Subject to any disclaimer, the term of this patent is extended or adjusted under 35 U.S.C. 154(b) by 129 days.

(21) Appl. No.: 12/000,399

(22) Filed: Dec. 12, 2007

(65) Prior Publication Data

US 2009/0156440 A1 Jun. 18, 2009

(51) Int. Cl.

| | |
|---|---|
| ***C10M 105/68*** | (2006.01) |
| ***C10M 105/78*** | (2006.01) |
| ***C10M 105/22*** | (2006.01) |
| ***C10M 105/28*** | (2006.01) |
| ***C10M 137/10*** | (2006.01) |
| ***C10M 133/56*** | (2006.01) |
| ***C10M 169/04*** | (2006.01) |

(52) U.S. Cl.

CPC ..... *C10M 133/56* (2013.01); *C10M 169/04* (2013.01); *C10M 2203/1006* (2013.01); *C10M 2207/023* (2013.01); *C10M 2207/027* (2013.01); *C10M 2207/144* (2013.01); *C10M 2207/146* (2013.01); *C10M 2207/262* (2013.01); *C10M 2215/28* (2013.01); *C10M 2223/045* (2013.01); *C10N 2210/01* (2013.01); *C10N 2210/02* (2013.01); *C10N 2230/02* (2013.01); *C10N 2230/04* (2013.01); *C10N 2230/041* (2013.01); *C10N 2230/52* (2013.01); *C10N 2240/102* (2013.01)

(58) Field of Classification Search

CPC ..... C10M 133/30; C10M 133/38; C10M 2207/00; C10M 2207/24; C10M 2207/34; C10M 133/56; C10M 169/04; C10M 2207/262; C10M 2207/144; C10M 2223/045; C10M 2207/027; C10M 2207/146; C10N 2230/041; C10N 2230/02; C10N 2230/52; C10N 2240/102; C10N 2210/01; C10N 2230/04

USPC ..... 508/287, 228, 229, 291, 459, 588

See application file for complete search history.

(56) References Cited

U.S. PATENT DOCUMENTS

| | | | | |
|---|---|---|---|---|
| 4,627,928 | A | 12/1986 | Karn | |
| 4,863,622 | A * | 9/1989 | Chiu | 508/444 |
| 5,616,543 | A * | 4/1997 | Cook | 508/239 |
| 5,672,572 | A * | 9/1997 | Arai et al. | 508/364 |
| 6,103,672 | A * | 8/2000 | Dunn et al. | 508/185 |
| 6,521,571 | B1 * | 2/2003 | Garner et al. | 508/359 |
| 6,596,038 | B1 * | 7/2003 | Moreton et al. | 44/389 |
| 2002/0098992 | A1 * | 7/2002 | Dunn et al. | 508/460 |
| 2002/0128160 | A1 | 9/2002 | Dunn et al. | |
| 2004/0235686 | A1 * | 11/2004 | Boons et al. | 508/460 |
| 2005/0137100 | A1 | 6/2005 | Le Coent et al. | |
| 2006/0052259 | A1 | 3/2006 | Le Coent et al. | |
| 2007/0027043 | A1 | 2/2007 | Le Coent | |

FOREIGN PATENT DOCUMENTS

| | | | |
|---|---|---|---|
| EP | 1016706 | A2 | 7/2000 |
| EP | 1154012 | A2 | 11/2001 |
| EP | 1209218 | | 5/2002 |
| EP | 1486556 | A1 | 12/2004 |
| EP | 1790710 | A1 | 5/2007 |
| JP | 2005263861 | A * | 9/2005 |
| WO | WO 2006/064138 | | 6/2006 |

OTHER PUBLICATIONS

"Role of nitrogen in tribochemical interaction between Zndtp and succinimide in boundary lubrication" Tribology International 33 (2000) 453-459.*

* cited by examiner

*Primary Examiner* — Pamela H Weiss
(74) *Attorney, Agent, or Firm* — Jones Day

(57) ABSTRACT

This invention encompasses trunk piston engine lubricating oil compositions, comprising a major amount of one or more Group I base oils; and one or more dispersant additives, wherein the concentration of the one or more dispersant additives within the trunk piston engine lubricating oil composition is about 0.2-0.6 wt. % on an actives basis; and methods for making and using the trunk piston engine lubricating oil compositions.

9 Claims, No Drawings

TRUNK PISTON ENGINE LUBRICATING OIL COMPOSITIONS

FIELD OF THE INVENTION

This invention relates to lubricating oil compositions, and more specifically relates to lubricating oil compositions for lubricating trunk piston engines.

BACKGROUND

Trunk piston engines typically operate using various types and qualities of diesel fuels and heavy fuel oils. When heavy fuel oils and conventional lubricant oil compositions mix in different temperature regions of trunk piston engines, however, black sludge (such as asphaltene deposits or other deposits) and other asphaltene derived deposits (such as undercrown deposits) tends to form. Such black sludge or deposit formation can adversely affect the service interval and maintenance cost of trunk piston engines.

Several attempts have been made to develop a lubricating oil composition having improved performance within trunk piston engines operating on heavy fuel oils. For example, EP 1154012 discusses a dispersant-free lubricating oil composition comprising an oil of lubricating viscosity, an overbased metal detergent, and an antiwear additive, wherein the composition can contain small amounts of a dispersant provided that the composition does not substantially demonstrate the dispersancy effect of the component. Similarly, EP 1209218 discusses a dispersant-free lubricating oil composition comprising an oil of lubricating viscosity, an overbased metal detergent, and an antiwear additive, where the composition can contain less than or equal to 1 mass % of a dispersant.

A need still remains, however, for an improved trunk piston engine lubricating oil composition having a Group I base oil that both reduces black sludge formation in trunk piston engines using heavy fuel oil, and which is viscosity-stabilized such that it is resistant to oxidation-based viscosity increase.

BRIEF SUMMARY OF THE INVENTION

In one aspect, the present invention relates to a trunk piston engine lubricating oil composition, comprising a major amount of one or more Group I base oils; and one or more dispersant additives, where the concentration of the one or more dispersant additives within the trunk piston engine lubricating oil composition is about 0.2-0.6 wt. % on an actives basis, and where the composition has a total base number of at least about 12.

In another aspect, the present invention relates to a black sludge-minimizing trunk piston engine lubricating oil composition, comprising a major amount of one or more Group I base oils; and one or more dispersant additives, where the concentration of the one or more dispersant additives within the trunk piston engine lubricating oil composition is about 0.2-0.6 wt. % on an actives basis, where the composition has a total base number of at least about 12, and where the trunk piston engine lubricating oil composition reduces black sludge formation in an engine by at least about 5%, when compared to a dispersant-free lubricating oil composition.

In another aspect, the present invention relates to a viscosity-stabilized trunk piston engine lubricating oil composition, comprising a major amount of one or more Group I base oils; and one or more dispersant additives, where the concentration of the one or more dispersant additives within the trunk piston engine lubricating oil composition is about 0.2-0.6 wt. % on an actives basis, where the composition has a total base number of at least about 12, and where the composition has at least about 5% less oxidation-based viscosity increase, when compared to a dispersant-free lubricating oil composition.

In another aspect, the present invention relates to a method for making a trunk piston engine lubricating oil composition, comprising mixing a major amount of one or more Group I base oils; and one or more dispersant additives, where the concentration of the one or more dispersant additives within the trunk piston engine lubricating oil composition is about 0.2-0.6 wt. % on an actives basis, and where the composition has a total base number of at least about 12.

In another aspect, the present invention relates to a method for reducing black sludge and deposit formation in an engine, comprising lubricating the engine with a trunk piston engine lubricating oil composition, comprising a major amount of one or more Group I base oils; and one or more dispersant additives, where the concentration of the one or more dispersant additives within the trunk piston engine lubricating oil composition is about 0.2-0.6 wt. % on an actives basis, and where the composition has a total base number of at least about 12.

In another aspect, the present invention relates to a method for operating a trunk piston engine, comprising lubricating the trunk piston engine with a trunk piston engine lubricating oil composition comprising: one or more Group I base oils; and one or more dispersant additives, where the concentration of the one or more dispersant additives within the trunk piston engine lubricating oil composition is about 0.2-0.6 wt. % on an actives basis, and where the composition has a total base number of at least about 12.

Several embodiments of the invention, including the above aspects of the invention, are described in further detail as follows. Generally, each of these embodiments can be used in various and specific combinations, and with other aspects and embodiments unless otherwise stated herein.

DETAILED DESCRIPTION OF THE INVENTION

To facilitate the understanding of the subject matter disclosed herein, a number of terms, abbreviations or other shorthand as used herein are defined below. Any term, abbreviation or shorthand not defined is understood to have the ordinary meaning used by a skilled artisan contemporaneous with the submission of this application.

"A major amount" of a base oil refers to a concentration of the base oil within the lubricating oil composition of at least about 40 wt. %. In some embodiments, "a major amount" of a base oil refers to a concentration of the base oil within the lubricating oil composition of at least about 50 wt. %, at least about 60 wt. %, at least about 70 wt. %, at least about 80 wt. %, or at least about 90 wt. %.

"On an actives basis" indicates that only the active component(s) of a particular additive are considered when determining the concentration or amount of that particular additive within the overall trunk piston engine lubricating oil composition. Diluents and any other inactive components of the additive, such as diluent oil, are excluded. Unless otherwise indicated, in describing the trunk piston engine lubricating oil composition, concentrations provided herein for the one or more dispersant additives are indicative of the concentration of the dispersant (and not of any inactive components within the dispersant additive, such as diluent oil) within the trunk piston engine lubricating oil composition.

In the following description, all numbers disclosed herein are approximate values, regardless whether the word "about" or "approximate" is used in connection therewith. They may vary by 1 percent, 2 percent, 5 percent, or, sometimes, 10 to 20 percent. Whenever a numerical range with a lower limit, RL, and an upper limit, RU, is disclosed, any number falling within the range is specifically disclosed. In particular, the following numbers within the range are specifically disclosed: R=RL+k*(RU−RL), wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed.

The lubricating oil compositions, trunk piston engine lubricating oil compositions, and trunk piston engine oils (TPEO) described herein (collectively "lubricating oil compositions") can be used for lubricating any trunk piston engine or compression-ignited (diesel) marine engine, such as a 4-stroke trunk piston engine or 4-stroke diesel marine engine.

The lubricating oil compositions have surprisingly been found to be viscosity-stabilized, black sludge-minimizing, low deposit-forming, deposition-reducing, deposit-minimizing, asphaltene deposit or other deposit minimizing, asphaltene stabilizing, oxidative thermal strain-stabilized, and combinations thereof, such as when mixed or combined with a heavy fuel oil (such as an asphaltene-containing or an unburnt asphaltene-containing heavy fuel oil). In this regard, the lubricating oil composition is mixable or combinable with a heavy fuel oil (such as an asphaltene-containing heavy fuel oil) to form a mixture or system having low, minimal, or no black sludge formation (e.g., asphaltene deposits or other deposits), such as in different temperature regions (e.g., cooling gallery of the pistons, piston ring groove area, combustion chamber, or other cooling regions) of a trunk piston engine (such as a region having a temperature of about 300° C. or less, about 280° C. or less, about 260° C. or less, about 240° C. or less, about 220° C. or less, about 200° C. or less, about 180° C. or less, about 160° C. or less, about 140° C. or less, about 100° C. or less, about 80° C. or less, about 60° C. or less, or about 40° C. or less. In some preferred embodiments, the lubricating oil compositions reduce black sludge (or black sludge deposit) formation in an engine (such as an engine using a heavy fuel oil, e.g., an asphaltene-containing heavy fuel oil) by at least about 5%, at least about 10% or more, at least about 15% or more, at least about 20% or more, at least about 30% or more, at least about 40% or more, at least about 50% or more, at least about 60% or more, at least about 70% or more, at least about 80% or more, or even at least about 90% or more, when compared to a dispersant-free lubricating oil composition. In another preferred embodiment, the lubricating oil compositions reduce black sludge formation (e.g., asphaltene or other deposition) in an engine by at least about 5%, at least about 10% or more, at least about 15% or more, at least about 20% or more, at least about 30% or more, at least about 40% or more, at least about 50% or more, at least about 60% or more, at least about 70% or more, at least about 80% or more, or even at least about 90% or more, when compared to a lubricating oil composition having more than 0.6 wt. %, more than 0.7 wt. %, more than 0.8 wt. %, more than 0.9 wt. %, or even more than 1.0 wt. % of a dispersant. Reductions in black sludge formation can be measured in any suitable manner, preferably via a Black Sludge Deposit (BSD) Test (such as is described Examples 1 and 3).

In some preferred embodiments, the lubricating oil compositions form about 5% less, about 10% less, about 15% less, about 20% less, about 30% less, about 40% less, about 50% less, about 60% less, about 70% less, about 80% less, or even about 90% less black sludge (e.g., asphaltene or other deposits), when mixed (such as in an engine) with a heavy fuel oil (such as an asphaltene-containing or unburnt asphaltene containing heavy fuel oil), when compared to a dispersant-free lubricating oil composition. In another preferred embodiment, the lubricating oil compositions form about 5% less, about 10% less, about 15% less, about 20% less, about 30% less, about 40% less, about 50% less, about 60% less, about 70% less, about 80% less, or even about 90% less black sludge (e.g., asphaltene or other deposits), when mixed with a heavy fuel oil (such as asphaltene or unburnt asphaltene containing heavy fuel oil), when compared to a lubricating oil composition comprising more than about 1 wt. %, more than about 0.9 wt. %, more than about 0.8 wt. %, more than 0.7 wt. %, or even more than about 0.6 wt. %.

In other aspects, some preferred lubricating oil compositions are viscosity-stabilized trunk piston engine lubricating oil compositions. In a preferred embodiment, the lubricating oil compositions have at least about 5%, at least about 10% less, at least about 15%, at least about 20%, at least about 25%, at least about 30%, at least about 40%, at least about 50%, at least about 60%, at least about 70%, at least about 80%, or even at least about 90% less oxidation-based viscosity increase, when compared to a dispersant-free lubricating oil composition.

In another preferred embodiment, the lubricating oil compositions are at least about 5%, at least about 10%, at least about 15%, at least about 20%, at least about 25%, at least about 30%, at least about 40%, at least about 50%, at least about 60%, at least about 70%, at least about 80%, or even at least about 90% more stable or stabilized against oxidation-based viscosity increase, oxidative thermal strain, or combinations thereof, when compared to a dispersant-free lubricating oil composition. Viscosity stabilization, and stability against oxidation-based viscosity increase, oxidative thermal strain, and combinations thereof, can be measured in any suitable manner, such as via a Modified Institute of Petroleum 48 (MIP48) test (such as is described in Example 2).

The lubricating oil compositions can have any total base number (TBN) that is suitable for use in trunk piston engines. For example, in some embodiments, the lubricating oil compositions can have a TBN of at least about 12, at least about 14, at least about 16, or at least about 18. In other embodiments, the lubricating oil compositions have a TBN of at least about 20, at least about 25, at least about 30, at least about 35, at least about 40, at least about 50, or even at least about 60. In other embodiments, the lubricating oil compositions have a TBN less than about 100, less than about 90, less than about 80, less than about 70, less than about 60, less than about 50, or less than about 40. In other embodiments, the lubricating oil compositions have a TBN in the range from about 12 to about 70, such as in a range from about 20 to about 70, a range from about 12 to about 60, a range from about 20 to about 60, a range from about 12 to about 50, a range from about 20 to about 50, a range from about 30 to about 60, a range from about 30 to about 50. The TBN of the lubricating oil compositions can be measured by any suitable method, such as by ASTM D2896.

The lubricating oil compositions can have any viscosity that is suitable for use in a trunk piston engine. [In one embodiment, the lubricating oil composition has a viscosity of at least about 5, at least about 10, at least about 15, or at least about 20 cSt at 100° C. In another embodiment, the lubricating oil composition has a viscosity of about 5.6-21.9 cSt at 100° C., such as about 5.6-9.3, about 9.3-12.5, about 12.5-16.3, or about 16.3-21.9 cSt at 100° C.] The viscosity of the lubricating oil composition can be measured in any suitable method, such as by ASTM D2270.

The lubricating oil compositions disclosed herein can be prepared by any method known to a person of ordinary skill in the art for making lubricating oils. In some embodiments, one or more Group I base oils can be blended or mixed with one or more dispersants. Optionally, one or more other additives in addition to the one or more dispersants can be added. The one or more dispersants and the optional additives may be added to one or more Group I base oils individually or simultaneously. In some embodiments, the one or more dispersants and the optional additives are added to one or more Group I base oils individually in one or more additions and the additions may be in any order. In other embodiments, the one or more dispersants and the additives are added to one or more Group I base oils simultaneously, optionally in the form of an additive concentrate. In some embodiments, the solubilizing of the one or more dispersants or any solid additives in one or more Group I base oils may be assisted by heating the mixture to a temperature from about 25° C. to about 200° C., from about 50° C. to about 150° C. or from about 75° C. to about 125° C.

Any suitable mixing or dispersing equipment may be used for blending, mixing or solubilizing the ingredients. The blending, mixing or solubilizing may be carried out with a blender, an agitator, a disperser, a mixer (e.g., planetary mixers and double planetary mixers), a homogenizer (e.g., Gaulin homogenizers and Rannie homogenizers), a mill (e.g., colloid mill, ball mill and sand mill) or any other mixing or dispersing equipment known in the art.

The lubricating oil compositions described herein can also be used for any suitable method of using a lubricating oil composition. In one preferred embodiment, a method is provided for operating a trunk piston engine, comprising lubricating the trunk piston engine with any of the lubricating oil compositions described herein. In another preferred embodiment, a method is provided for reducing black sludge formation in an engine, comprising lubricating an engine with any of the lubricating oil compositions described herein. It is preferred, in some embodiments of these methods, for minimal, low, or no black sludge formation (e.g., asphaltene or other deposition) in said engine or trunk piston engine (such as during use or operation of the engine using a heavy fuel oil, such as an asphaltene-containing heavy fuel oil), such as in different temperature regions (e.g., cooling galleries of the pistons or other cooling regions) of the engine or trunk piston engine, such as a region having a temperature of about 300° C. or less, about 280° C. or less, about 260° C. or less, about 240° C. or less, about 220° C. or less, about 200° C. or less, about 180° C. or less, about 160° C. or less, about 140° C. or less, about 100° C. or less, about 80° C. or less, about 60° C. or less, or about 40° C. or less.

In other preferred embodiments of the methods, black sludge formation in the engine or trunk piston engine (such as during use or operation of the engine or trunk piston engine using a heavy fuel oil) (such as in lower temperature regions of the engine or trunk piston engine) is reduced by at least about 5%, at least about 10%, at least about 15%, at least about 20%, at least about 30%, at least about 40%, at least about 50%, at least about 60%, at least about 70%, at least about 80%, or even at least about 90%, when compared to the same method using a dispersant-free lubricating oil composition. In other preferred embodiments of the methods, black sludge formation in the engine or trunk piston engine (such as during use or operation of the engine using a heavy fuel oil) (such as in lower temperature regions of the engine or trunk piston engine) is reduced by at least about 5%, at least about 10%, at least about 15%, at least about 20%, at least about 30%, at least about 40%, at least about 50%, at least about 60%, at least about 70%, at least about 80%, or even at least about 90%, when compared to the same method using a lubricating oil composition having more than 0.6 wt. %, more than 0.7 wt. %, more than 0.8 wt. %, more than 0.9 wt. %, or even more than 1.0 wt. % of a dispersant.

Base Oil:

In a preferred embodiment, the base oil is a Group I base oil, or a blend of two or more different Group I base oils. The Group I base oils can be any petroleum derived base oil of lubricating viscosity as defined by the American Petroleum Institute (API) Publication 1509, Fourteen Edition, December 1996 (i.e., API Base Oil Interchangeability Guidelines for Passenger Car Motor Oils and Diesel Engine Oils), which is incorporated herein by reference in its entirety. The API guideline defines a base stock as a lubricant component that may be manufactured using a variety of different processes. In this regard, a Group I base oil is a mineral oil having a total sulfur content greater than or equal to about 0.03 wt. % (as determined by ASTM D 2270), a saturates content less than about 90 wt. % (as determined by ASTM D 2007), and a viscosity index (VI) of about 80-120 (as determined by ASTM D 4294, ASTM D 4297 or ASTM D 3120).

Group I base oils can comprise light overhead cuts and heavier side cuts from a vacuum distillation column and can also include, for example, Light Neutral, Medium Neutral, and Heavy Neutral base stocks. The petroleum derived base oil also may include residual stocks or bottoms fractions, such as, for example, bright stock. Bright stock is a high viscosity base oil which has been conventionally produced from residual stocks or bottoms and has been highly refined and dewaxed. Bright stock can have a kinematic viscosity greater than about 180 cSt at 40° C., or even greater than about 250 cSt at 40° C., or even ranging from about 500 to about 1100 cSt at 40° C.

In another preferred embodiment, the base oil can be a blend or mixture of two or more, three or more, or even four or more Group I base oils having different molecular weights and viscosities, wherein the blend is processed in any suitable manner to create a base oil having suitable properties (such as the viscosity and TBN values, discussed above) for use in a trunk piston engine. In one embodiment, the base oil comprises ExxonMobil CORE® 100, ExxonMobil CORE® 150, ExxonMobil CORE® 600, ExxonMobil CORE® 2500, or a combination or mixture thereof. In this regard, examples 1-2 of the present application, for instance, describe twelve different blends of three Group I base oils (specifically, ExxonMobil CORE® 150, ExxonMobil CORE® 600, ExxonMobil CORE® 2500), wherein each of the final blended compositions had a viscosity of about 145 cSt at 40° C. and a TBN of about 41.

Dispersant Additive

The dispersant additive ("dispersant") can be in any suitable form. In one embodiment, the dispersant is mixed or blended in the lubricating oil composition in the form of a dispersion or suspension comprising any suitable process or diluent oil (such as any Group I oil, Group II oil, or combination or mixture thereof) and the dispersant. In one embodiment, the process or diluent oil is an oil that is different from the base oil (e.g., Group I base oil) of the lubricating oil composition, such as a different Group I base oil, a Group II base oil, or a mixture or combination thereof. In another embodiment, the process or diluent oil is an oil that is the same as the base oil (e.g., Group I base oil) of the lubricating oil composition.

The dispersant can be any suitable dispersant or mixture of multiple dispersants for use in a lubricating engine oil. In one embodiment, the dispersant is an ashless dispersant, such as an ashless dispersant that comprises an alkenyl- or alkyl-succinimide or a derivative thereof, such as a polyalkylene succinimide (preferably, polyisobutene succinimide). In another embodiment, the dispersant is an alkali metal or mixed alkali metal, alkaline earth metal borate, dispersion of hydrated alkali metal borate, dispersion of alkaline-earth metal borate, polyamide ashless dispersant, benzylamine, Mannich type dispersant, phosphorus-containing dispersant, or combination or mixture thereof. These and other suitable dispersants have been described in Mortier et al., "Chemistry and Technology of Lubricants," 2nd Edition, London, Springer, Chapter 3, pages 86-90 (1996); and Leslie R. Rudnick, "Lubricant Additives: Chemistry and Applications," New York, Marcel Dekker, Chapter 5, pages 137-170 (2003), both of which are incorporated herein by reference in their entirety. In a preferred embodiment, the dispersant is a succinimide or a derivative thereof. In another embodiment, the dispersant is a succinimide or derivative thereof which is obtained by reaction of a polybutenylsuccinic anhydride and a polyamine. In another embodiment, the dispersant is a succinimide or derivative thereof which is obtained by reaction of a polybutenylsuccinic anhydride and a polyamine, wherein the polybutenylsuccinic anhydride is produced from polybutene and maleic anhydride (such as by a thermal reaction method using neither chlorine or a chlorine atom-containing compound). In another preferred embodiment, the dispersant is a succinimide reaction product of the condensation reaction between polyisobutenyl succinic anhydride (PIBSA) and one or more alkylene polyamines. The PIBSA, in this embodiment, can be the thermal reaction product of high methylvinylidene polyisobutene (PIB) and maleic anhydride. In another preferred embodiment, the dispersant is a primarily bis-succinimide reaction product derived from PIB having a number average molecular weight (Mn) of about 500-3000, such as about 600-2800, about 700-2700, about 800-2600, about 900-2500, about 1000-2400, about 1100-2300, about 1200-2200, about 1300-2100, or even about 1400-2000. In another preferred embodiment, the dispersant is a primarily bis-succinimide reaction product derived from PIB having a Mn of at least about 600, at least about 800, at least about 1000, at least about 1100, at least about 1200, at least about 1300, at least about 1400, at least about 1500, at least about 1600, at least about 1700, at least about 1800, at least about 1900, at least about 2000, at least about 2100, at least about 2200, at least about 2300, at least about 2400, at least about 2500, at least about 2600, at least about 2700, at least about 2800, at least about 2900, at least about 3000. In one preferred embodiment, for example, the dispersant is a primarily bis-succinimide reaction product derived from 1000 Mn PIB, which succinimide in another preferred embodiment is subsequently borated to achieve a boron concentration of about 0.1-3 wt. % (such as about 1-2 wt. %, such as 1.2 wt. %) in the succinimide. In another preferred embodiment, the dispersant is a primarily bis-succinimide reaction product derived from 1300 Mn PIB, which succinimide in another preferred embodiment is subsequently borated to achieve a boron concentration of about 0.1-3 wt. % (such as about 1-2 wt. %, such as 1.2 wt. %) in the succinimide. In another preferred embodiment, the dispersant is a primarily bis-succinimide reaction product derived from 2300 Mn PIB, which succinimide in another preferred embodiment is subsequently reacted with ethylene carbonate.

In another preferred embodiment, the dispersant is a succinimide prepared by the reaction of a high molecular weight alkenyl- or alkyl-substituted succinic anhydride and a polyalkylene polyamine having 4 to 10 nitrogen atoms (average value), preferably 5 to 7 nitrogen atoms (average value) per mole. The alkenyl or alkyl group of the alkenyl or alkyl succinimide compound, in this regard, can be derived from a polybutene having a number average molecular weight of about 900-3000, such as about 1000-2500, about 1200-2300, or even about 1400-2100. In some embodiments, the reaction between polybutene and maleic anhydride for the preparation of polybutenyl succinic anhydride can be performed by a chlorination process using chlorine. Accordingly, in some embodiments, the resulting polybutenyl succinic anhydride as well as a polybutenyl succinimide produced from the polybutenyl succinic anhydride has a chlorine content in the range of approximately 2,000 to 3,000 ppm (wt). In contrast, a thermal process using no chlorine gives a polybutenyl succinic anhydride and a polybutenyl succinimide having a chlorine content in a range of such as less than 30 ppm (wt). Therefore, a succinimide derived from a succinic anhydride produced by the thermal process is preferred, in some embodiments, due to the smaller chlorine content in the lubricating oil composition.

In another preferred embodiment, the dispersant comprises a modified alkenyl- or alkyl-succinimide which is after-treated with a compound selected from a boric acid, an alcohol, an aldehyde, a ketone, an alkylphenol, a cyclic carbonate (e.g., ethylene carbonate), an organic acid, a succiamide, a succinate ester, a succinate ester-amide, pentaerythritol, phenate-salicylate and their post-treated analogs or the like, or combinations or mixtures thereof. Preferable modified succinimides are borated alkenyl- or alkyl-succinimides, such as alkenyl- or alkyl-succinimides which are after-treated with boric acid or a boron-containing compound. In another embodiment, the dispersant comprises alkenyl- or alkyl-succinimide that has not been after- or post-treated.

Preferably, the concentration of the one or more dispersants within the lubricating oil composition on an actives basis is less than about 1.0 wt. %, less than about 0.9 wt. %, less than about 0.8 wt. %, less than about 0.7 wt. %, less than about 0.6 wt. %, less than about 0.5 wt. %, less than about 0.4 wt. %, less than about 0.3 wt. %, or even less than about 0.2 wt. %. In other preferred embodiments, the concentration of the one or more dispersant additives within the lubricating oil composition on an actives basis is about 0.1-1 wt. %, about 0.2-0.9 wt. %, 0.1-0.8 wt. %, about 0.2-0.8 wt. %, about 0.3-0.8 wt. %, 0.1-0.7 wt. %, 0.2-0.7 wt. %, about 0.3-0.7 wt. %, about 0.4-0.7 wt. %, about 0.1-0.6 wt. %, about 0.2-0.6 wt. %, about 0.3-0.6 wt. %, about 0.4-0.6 wt. %, about 0.5-0.6 wt. %, about 0.1-0.5 wt. %, about 0.2-0.5 wt. %, about 0.1-0.4 wt. %, 0.2-0.4 wt. %, 0.3-0.6 wt. %, or even about 0.3-0.5 wt. %.

Detergent Additive:

The lubricating oil composition may also comprise any suitable one or more (such as two or more, three or more, or even four our more) detergent additives ("detergents"), such as non-overbased detergents, overbased detergents, overbased metal detergents, overbased carboxylate-containing detergents (such as overbased carboxylate metal-containing detergents), or combinations or mixtures thereof. An overbased detergent additive can be any detergent additive in which the TBN of the additive has been increased by a process such as the addition of a base source (such as lime), and an acidic overbasing compound (such as carbon dioxide).

Preferably, the detergent comprises a salt, such as an overbased salt, of an alkyl-substituted hydroxybenzoic acid. In a preferred embodiment, the detergent can be an alkaline earth salt (such as calcium or magnesium) of an alkyl-substituted hydroxybenzoic acid. In some embodiments, greater than about 75% (preferably greater than about 80%, greater than about 85%, greater than about 90%, or even greater than about 95%) of the alkyl-group of alkyl-substituted hydroxybenzoic acid is a residue of linear alpha-olefin having 20 or more carbons, such as 22 or more, 24 or more, 26 or more, 28 or more, or even 30 or more carbons. In a preferred embodiment, the one or more detergents comprise an overbased salt (such as an overbased alkaline earth metal salt) of a mixture of alkyl-substituted hydroxybenzoic acid and alkyl-substituted phenol. In this regard, for example, the one or more detergents can comprise a mixture of an overbased salt of an alkyl-substituted hydroxybenzoic acid and an overbased salt of an alkyl-substituted phenol. In another preferred embodiment, the lubricating oil composition comprises one or more detergents comprising an overbased salt of an alkyl-substituted hydroxybenzoic acid, wherein the lubricating oil composition comprises no other overbased salts (other than the salt of the dispersant). In another preferred embodiment, the detergent of the lubricating oil composition consists essentially of a salt of an alkyl-substituted hydroxybenzoic acid. In another preferred embodiment, the detergent of the lubricating oil composition does not contain a salt of an oil-soluble sulfonic acid. In another preferred embodiment, the detergent of the lubricating oil composition does not contain an alkyl phenate. In another preferred embodiment, the detergent of the lubricating oil composition does not contain a salt of an oil-soluble sulfonic acid or an alkyl phenate. In some embodiments, the detergent comprises an alkyl phenate and an overbased salt of an alkyl-substituted hydroxybenzoic acid.

In another preferred embodiment, the lubricating oil composition comprises a carboxylate-containing detergent that comprises:

(a) a multi-surfactant unsulfurized, non-carbonated, non-overbased, carboxylate-containing additive prepared, for example, according to the method described in Example 1 of U.S. Patent Application Publication No. 2004/0235686, the contents of which are incorporated herein by reference in their entirety; or (b) an overbased calcium alkylhydroxybenzoate additive prepared, for example, according to the method described in Example 1 of U.S. Patent Application Publication No. 2007/0027043, the contents of which are incorporated herein by reference in their entirety;

or combinations or mixtures thereof. In one preferred embodiment, the lubricating oil composition comprises a mixture of (a) and (b).

Some non-limiting examples of suitable metal detergents include sulfurized or unsulfurized alkyl or alkenyl phenates, alkyl or alkenyl aromatic sulfonates, borated sulfonates, sulfurized or unsulfurized metal salts of multi hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, and chemical and physical mixtures thereof. Other non-limiting examples of suitable metal detergents include metal sulfonates, phenates, salicylates, phosphonates, thiophosphonates and combinations thereof. The metal can be any metal suitable for making sulfonate, phenate, salicylate or phosphonate detergents. Non-limiting examples of suitable metals include alkali metals, alkaline metals and transition metals. In some embodiments, the metal is Ca, Mg, Ba, K, Na, Li or the like.

Generally, the amount of the detergent is from about 0.001 wt. % to about 5 wt. %, from about 0.05 wt. % to about 3 wt. %, or from about 0.1 wt. % to about 1 wt. %, based on the total weight of the lubricating oil composition. Some suitable detergents have been described in Mortier et al., "Chemistry and Technology of Lubricants," 2nd Edition, London, Springer, Chapter 3, pages 75-85 (1996); and Leslie R. Rudnick, "Lubricant Additives: Chemistry and Applications," New York, Marcel Dekker, Chapter 4, pages 113-136 (2003), both of which are incorporated herein by reference in their entirety.

Lubricating Oil Additives

Optionally, the lubricating oil composition may further comprise at least an additive or a modifier (hereinafter designated as "additive") that can impart or improve any desirable property of the lubricating oil composition. Any suitable additive may be used in the lubricating oil compositions disclosed herein. Some suitable additives have been described in Mortier et al., "Chemistry and Technology of Lubricants," 2nd Edition, London, Springer, (1996); and Leslie R. Rudnick, "Lubricant Additives: Chemistry and Applications," New York, Marcel Dekker (2003), both of which are incorporated herein by reference. In some embodiments, the additive can be selected from the group consisting of antioxidants, antiwear agents, detergents, rust inhibitors, demulsifiers, friction modifiers, multi-functional additives, viscosity index improvers, pour point depressants, foam inhibitors, metal deactivators, dispersants, corrosion inhibitors, lubricity improvers, thermal stability improvers, anti-haze additives, icing inhibitors, dyes, markers, static dissipaters, biocides and combinations and mixtures thereof. In general, the concentration of each of the additives in the lubricating oil composition, when present, may range from about 0.001 wt. % to about 10 wt. %, from about 0.01 wt. % to about 5 wt. %, or from about 0.1 wt. % to about 2.5 wt. %, based on the total weight of the lubricating oil composition. Further, the total amount of the additives in the lubricating oil composition may range from about 0.001 wt. % to about 20 wt. %, from about 0.01 wt. % to about 10 wt. %, or from about 0.1 wt. % to about 5 wt. %, based on the total weight of the lubricating oil composition.

The lubricating oil composition disclosed herein can optionally comprise an anti-wear agent that can reduce friction and excessive wear. Any suitable anti-wear agent may be used in the lubricating oil composition. Non-limiting examples of suitable anti-wear agents include zinc dithiophosphate, metal (e.g., Pb, Sb, Mo and the like) salts of dithiophosphate, metal (e.g., Zn, Pb, Sb, Mo and the like) salts of dithiocarbamate, metal (e.g., Zn, Pb, Sb and the like) salts of fatty acids, boron compounds, phosphate esters, phosphite esters, amine salts of phosphoric acid esters or thiophosphoric acid esters, reaction products of dicyclopentadiene and thiophosphoric acids and combinations thereof. The amount of the anti-wear agent may vary from about 0.01 wt. % to about 5 wt. %, from about 0.05 wt. % to about 3 wt. %, or from about 0.1 wt. % to about 1 wt. %, based on the total weight of the lubricating oil composition. Some suitable anti-wear agents have been described in Leslie R. Rudnick, "Lubricant Additives: Chemistry and Applications," New York, Marcel Dekker, Chapter 8, pages 223-258 (2003), which is incorporated herein by reference.

In certain embodiments, the anti-wear agent is or comprises a dihydrocarbyl dithiophosphate metal salt, such as zinc dialkyl dithiophosphate compounds, zinc diaryl dithiophosphate, or a combination or mixture thereof. The metal of the dihydrocarbyl dithiophosphate metal salt may be an alkali or alkaline earth metal, or aluminum, lead, tin, molybdenum, manganese, nickel or copper. In some embodiments, the metal is zinc. In other embodiments, the alkyl group of the dihydrocarbyl dithiophosphate metal salt has from about 3 to about 22 carbon atoms, from about 3 to about 18 carbon atoms, from about 3 to about 12 carbon atoms, or from about 3 to about 8 carbon atoms and may be linear or branched.

The amount of the dihydrocarbyl dithiophosphate metal salt including the zinc dialkyl dithiophosphate salts in the lubricating oil composition disclosed herein may be measured by its phosphorus content. In some embodiments, the phosphorus content of the lubricating oil composition disclosed herein is from about 0.01 wt. % to about 0.12 wt. %, from about 0.01 wt. % to about 0.10 wt. %, from about 0.02 wt. % to about 0.08 wt. %, or from about 0.02 wt. % to about 0.05 wt. % based on the total weight of the lubricating oil composition.

In one embodiment, the phosphorous content of the lubricating oil composition herein is from about 0.01 to 0.08 wt %, such as from about 0.02 to about 0.07 wt. %, from about 0.02 to about 0.06 wt. % or from about 0.02 to about 0.05 wt. % based on the total weight of the lubricating oil composition. In another embodiment, the phosphorous content of the lubricating oil composition herein is from about 0.05 to 0.12 wt % based on the total weight of the lubricating oil composition.

The dihydrocarbyl dithiophosphate metal salt may be prepared by first forming a dihydrocarbyl dithiophosphoric acid (DDPA), usually by reacting one or more of alcohols and phenolic compounds with $P_2S_5$ and then neutralizing the formed DDPA with a compound of the metal, such as an oxide, hydroxide or carbonate of the metal. In some embodiments, a DDPA may be made by reacting mixtures of primary and secondary alcohols with $P_2S_5$. In other embodiments, two or more dihydrocarbyl dithiophosphoric acids can be prepared where the hydrocarbyl groups on one are entirely secondary in character and the hydrocarbyl groups on the others are entirely primary in character. The zinc salts can be prepare from the dihydrocarbyl dithiophosphoric acids by reacting with a zinc compound. In some embodiments, a basic or a neutral zinc compound is used. In other embodiments, an oxide, hydroxide or carbonate of zinc is used.

In some embodiments, oil soluble zinc dialkyl dithiophosphates may be produced from dialkyl dithiophosphoric acids represented by formula (II):

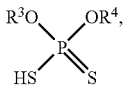

(II)

wherein each of $R^3$ and $R^4$ is independently linear or branched alkyl or linear or branched substituted alkyl. In some embodiments, the alkyl group has from about 3 to about 30 carbon atoms or from about 3 to about 8 carbon atoms.

The dialkyldithiophosphoric acids of formula (II) can be prepared by reacting alcohols $R^3OH$ and $R^4OH$ with $P_2S_5$ where $R^3$ and $R^4$ are as defined above. In some embodiments, $R^3$ and $R^4$ are the same. In other embodiments, $R^3$ and $R^4$ are different. In further embodiments, $R^3OH$ and $R^4OH$ react with $P_2S_5$ simultaneously. In still further embodiments, $R^3OH$ and $R^4OH$ react with $P_2S_5$ sequentially.

Mixtures of hydroxyl alkyl compounds may also be used. These hydroxyl alkyl compounds need not be monohydroxy alkyl compounds. In some embodiments, the dialkyldithiophosphoric acids is prepared from mono-, di-, tri-, tetra-, and other polyhydroxy alkyl compounds, or mixtures of two or more of the foregoing. In other embodiments, the zinc dialkyldithiophosphate derived from only primary alkyl alcohols is derived from a single primary alcohol. In further embodiments, that single primary alcohol is 2-ethylhexanol. In certain embodiments, the zinc dialkyldithiophosphate is derived from only secondary alkyl alcohols, such as a mixture of secondary alkyl alcohols. In further embodiments, the mixture of secondary alcohols is a mixture of 2-butanol and 4-methyl-2-pentanol.

The phosphorus pentasulfide reactant used in the dialkyldithiophosphoric acid formation step may contain certain amounts of one or more of $P_2S_3$, $P_4S_3$, $P_4S_7$, or $P_4S_9$. Compositions as such may also contain minor amounts of free sulfur. In certain embodiments, the phosphorus pentasulfide reactant is substantially free of any of $P_2S_3$, $P_4S_3$, $P_4S_7$, and $P_4S_9$. In certain embodiments, the phosphorus pentasulfide reactant is substantially free of free sulfur.

In the present invention, the sulfated ash content of the total lubricating oil composition is less than about 5 wt. %, less than about 4 wt. %, less than about 3 wt. %, less than about 2 wt. %, or even less than about 1 wt. %, as measured according to ASTM D874.

Optionally, the lubricating oil composition disclosed herein can further comprise an additional antioxidant that can reduce or prevent the oxidation of the base oil. Any suitable antioxidant may be used in the lubricating oil composition. Non-limiting examples of suitable antioxidants include amine-based antioxidants (e.g., alkyl diphenylamines, phenyl-α-naphthylamine, alkyl or aralkyl substituted phenyl-α-naphthylamine, alkylated p-phenylene diamines, tetramethyl-diaminodiphenylamine and the like), phenolic antioxidants (e.g., 2-tert-butylphenol, 4-methyl-2,6-di-tert-butylphenol, 2,4,6-tri-tert-butylphenol, 2,6-di-tert-butyl-p-cresol, 2,6-di-tert-butylphenol, 4,4'-methylenebis-(2,6-di-tert-butylphenol), 4,4'-thiobis(6-di-tert-butyl-o-cresol) and the like), sulfur-based antioxidants (e.g., dilauryl-3,3'-thiodipropionate, sulfurized phenolic antioxidants and the like), phosphorous-based antioxidants (e.g., phosphites and the like), zinc dithiophosphate, oil-soluble copper compounds and combinations thereof. The amount of the antioxidant may vary from about 0.01 wt. % to about 10 wt. %, from about 0.05 wt. % to about 5 wt. %, or from about 0.1 wt. % to about 3 wt. %, based on the total weight of the lubricating oil composition. Some suitable antioxidants have been described in Leslie R. Rudnick, "Lubricant Additives: Chemistry and Applications," New York, Marcel Dekker, Chapter 1, pages 1-28 (2003), which is incorporated herein by reference.

The lubricating oil composition disclosed herein can optionally comprise a friction modifier that can lower the friction between moving parts. Any suitable friction modifier may be used in the lubricating oil composition. Non-limiting examples of suitable friction modifiers include fatty carboxylic acids; derivatives (e.g., alcohol, esters, borated esters, amides, metal salts and the like) of fatty carboxylic acid; mono-, di- or tri-alkyl substituted phosphoric acids or phosphonic acids; derivatives (e.g., esters, amides, metal salts and the like) of mono-, di- or tri-alkyl substituted phosphoric acids or phosphonic acids; mono-, di- or tri alkyl substituted amines; mono- or di-alkyl substituted amides and combinations thereof. In some embodiments, the friction modifier is selected from the group consisting of aliphatic amines, ethoxylated aliphatic amines, aliphatic carboxylic acid amides, ethoxylated aliphatic ether amines, aliphatic carboxylic acids, glycerol esters, aliphatic carboxylic ester-amides, fatty imidazolines, fatty tertiary amines, wherein the aliphatic or fatty group contains more than about eight carbon atoms so as to render the compound suitably oil soluble. In other embodiments, the friction modifier comprises an aliphatic substituted succinimide formed by reacting an aliphatic succinic acid or anhydride with ammonia or a primary amine. The amount of the friction modifier may vary from about 0.01 wt. % to about 10 wt. %, from about 0.05 wt. % to about 5 wt. %, or from about 0.1 wt. % to about 3 wt. %, based on the total weight of the lubricating oil composition. Some suitable friction modifiers have been described in Mortier et al., "Chemistry and Technology of Lubricants," 2nd Edition, London, Springer, Chapter 6, pages 183-187 (1996); and Leslie R. Rudnick, "Lubricant Additives: Chemistry and Applications," New York, Marcel Dekker, Chapters 6 and 7, pages 171-222 (2003), both of which are incorporated herein by reference.

The lubricating oil composition disclosed herein can optionally comprise a pour point depressant that can lower the pour point of the lubricating oil composition. Any suitable pour point depressant may be used in the lubricating oil composition. Non-limiting examples of suitable pour point depressants include polymethacrylates, alkyl acrylate polymers, alkyl methacrylate polymers, di(tetra-paraffin phenol) phthalate, condensates of tetra-paraffin phenol, condensates of a chlorinated paraffin with naphthalene and combinations thereof. In some embodiments, the pour point depressant comprises an ethylene-vinyl acetate copolymer, a condensate of chlorinated paraffin and phenol, polyalkyl styrene or the like. The amount of the pour point depressant may vary from about 0.01 wt. % to about 10 wt. %, from about 0.05 wt. % to about 5 wt. %, or from about 0.1 wt. % to about 3 wt. %, based on the total weight of the lubricating oil composition. Some suitable pour point depressants have been described in Mortier et al., "Chemistry and Technology of Lubricants," 2nd Edition, London, Springer, Chapter 6, pages 187-189 (1996); and Leslie R. Rudnick, "Lubricant Additives: Chemistry and Applications," New York, Marcel Dekker, Chapter 11, pages 329-354 (2003), both of which are incorporated herein by reference.

The lubricating oil composition disclosed herein can optionally comprise a demulsifier that can promote oil-water separation in lubricating oil compositions that are exposed to water or steam. Any suitable demulsifier may be used in the lubricating oil composition. Non-limiting examples of suitable demulsifiers include anionic surfactants (e.g., alkylnaphthalene sulfonates, alkyl benzene sulfonates and the like), nonionic alkoxylated alkylphenol resins, polymers of alkylene oxides (e.g., polyethylene oxide, polypropylene oxide, block copolymers of ethylene oxide, propylene oxide and the like), esters of oil soluble acids, polyoxyethylene sorbitan ester and combinations thereof. The amount of the demulsifier may vary from about 0.01 wt. % to about 10 wt. %, from about 0.05 wt. % to about 5 wt. %, or from about 0.1 wt. % to about 3 wt. %, based on the total weight of the lubricating oil composition. Some suitable demulsifiers have been described in Mortier et al., "Chemistry and Technology of Lubricants," 2nd Edition, London, Springer, Chapter 6, pages 190-193 (1996), which is incorporated herein by reference.

The lubricating oil composition disclosed herein can optionally comprise a foam inhibitor or an anti-foam that can break up foams in oils. Any suitable foam inhibitor or anti-foam may be used in the lubricating oil composition. Non-limiting examples of suitable anti-foams include silicone oils or polydimethylsiloxanes, fluorosilicones, alkoxylated aliphatic acids, polyethers (e.g., polyethylene glycols), branched polyvinyl ethers, alkyl acrylate polymers, alkyl methacrylate polymers, polyalkoxyamines and combinations thereof. In some embodiments, the anti-foam comprises glycerol monostearate, polyglycol palmitate, a trialkyl monothiophosphate, an ester of sulfonated ricinoleic acid, benzoylacetone, methyl salicylate, glycerol monooleate, or glycerol dioleate. The amount of the anti-foam may vary from about 0.01 wt. % to about 5 wt. %, from about 0.05 wt. % to about 3 wt. %, or from about 0.1 wt. % to about 1 wt. %, based on the total weight of the lubricating oil composition. Some suitable anti-foams have been described in Mortier et al., "Chemistry and Technology of Lubricants," 2nd Edition, London, Springer, Chapter 6, pages 190-193 (1996), which is incorporated herein by reference.

The lubricating oil composition disclosed herein can optionally comprise a corrosion inhibitor that can reduce corrosion. Any suitable corrosion inhibitor may be used in the lubricating oil composition. Non-limiting examples of suitable corrosion inhibitor include half esters or amides of dodecylsuccinic acid, phosphate esters, thiophosphates, alkyl imidazolines, sarcosines and combinations thereof. The amount of the corrosion inhibitor may vary from about 0.01 wt. % to about 5 wt. %, from about 0.05 wt. % to about 3 wt. %, or from about 0.1 wt. % to about 1 wt. %, based on the total weight of the lubricating oil composition. Some suitable corrosion inhibitors have been described in Mortier et al., "Chemistry and Technology of Lubricants," 2nd Edition, London, Springer, Chapter 6, pages 193-196 (1996), which is incorporated herein by reference.

The lubricating oil composition disclosed herein can optionally comprise an extreme pressure (EP) agent that can prevent sliding metal surfaces from seizing under conditions of extreme pressure. Any suitable extreme pressure agent may be used in the lubricating oil composition. Generally, the extreme pressure agent is a compound that can combine chemically with a metal to form a surface film that prevents the welding of asperities in opposing metal surfaces under high loads. Non-limiting examples of suitable extreme pressure agents include sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally-substituted dihydrocarbyl polysulfides, thia-aldehydes, thia-ketones, epithio compounds, sulfur-containing acetal derivatives, co-sulfurized blends of terpene and acyclic olefins, and polysulfide olefin products, amine salts of phosphoric acid esters or thiophosphoric acid esters and combinations thereof. The amount of the extreme pressure agent may vary from about 0.01 wt. % to about 5 wt. %, from about 0.05 wt. % to about 3 wt. %, or from about 0.1 wt. % to about 1 wt. %, based on the total weight of the lubricating oil composition. Some suitable extreme pressure agents have been described in Leslie R. Rudnick, "Lubricant Additives: Chemistry and Applications," New York, Marcel Dekker, Chapter 8, pages 223-258 (2003), which is incorporated herein by reference.

The lubricating oil composition disclosed herein can optionally comprise a rust inhibitor that can inhibit the corrosion of ferrous metal surfaces. Any suitable rust inhibitor may be used in the lubricating oil composition. Non-limiting examples of suitable rust inhibitors include oil-soluble monocarboxylic acids (e.g., 2-ethylhexanoic acid, lauric acid, myristic acid, palmitic acid, oleic acid, linoleic acid, linolenic acid, behenic acid, cerotic acid and the like), oil-soluble polycarboxylic acids (e.g., those produced from tall oil fatty acids, oleic acid, linoleic acid and the like), alkenylsuccinic acids in which the alkenyl group contains 10 or more carbon atoms (e.g., tetrapropenylsuccinic acid, tetradecenylsuccinic acid, hexadecenylsuccinic acid, and the like); long-chain alpha, omega-dicarboxylic acids having a molecular weight in the range of 600 to 3000 daltons and combinations thereof. The amount of the rust inhibitor may vary from about 0.01 wt. % to about 10 wt. %, from about 0.05 wt. % to about 5 wt. %, or from about 0.1 wt. % to about 3 wt. %, based on the total weight of the lubricating oil composition.

Other non-limiting examples of suitable rust inhibitors include nonionic polyoxyethylene surface active agents such as polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol mono oleate, and polyethylene glycol mono oleate. Further non-limiting examples of suitable rust inhibitor include stearic acid and other fatty acids, dicarboxylic acids, metal soaps, fatty acid amine salts, metal salts of heavy sulfonic acid, partial carboxylic acid ester of polyhydric alcohol, and phosphoric ester.

In some embodiments, the lubricating oil composition comprises at least a multifunctional additive. Some non-limiting examples of suitable multifunctional additives include sulfurized oxymolybdenum dithiocarbamate, sulfurized oxymolybdenum organophosphorodithioate, oxymolybdenum monoglyceride, oxymolybdenum diethylate amide, amine molybdenum complex compound, and sulfur containing molybdenum complex compound.

In some embodiments, the lubricating oil composition comprises at least a viscosity index improver. Some non-limiting examples of suitable viscosity index improvers include polymethacrylate type polymers, ethylene propylene copolymers, styrene-isoprene copolymers, hydrated styrene isoprene copolymers, polyisobutylene, and dispersant type viscosity index improvers.

In some embodiments, the lubricating oil composition comprises at least a metal deactivator. Some non-limiting examples of suitable metal deactivators include disalicylidene propylenediamine, triazole derivatives, thiadiazole derivatives, and mercaptobenzimidazoles.

The additives disclosed herein may be in the form of an additive concentrate having more than one additive. The additive concentrate may comprise a suitable diluent, such as a hydrocarbon oil of suitable viscosity. Such diluent can be selected from the group consisting of natural oils (e.g., mineral oils), synthetic oils and combinations thereof. Some non-limiting examples of the mineral oils include paraffin-based oils, naphthenic-based oils, asphaltic-based oils and combinations thereof. Some non-limiting examples of the synthetic base oils include polyolefin oils (especially hydrogenated alpha-olefin oligomers), alkylated aromatic, polyalkylene oxides, aromatic ethers, and carboxylate esters (especially diester oils) and combinations thereof. In some embodiments, the diluent is a light hydrocarbon oil, both natural or synthetic. In some embodiments, the diluent oil can have a viscosity from about 13 centistokes to about 35 centistokes at 40° C.

EXAMPLES

The following examples are given as particular embodiments of the invention and to demonstrate the advantages thereof. It is understood that the examples are given by way of illustration and are not intended to limit the specification or the claims that follow in any manner.

Example 1

The efficacy of 12 trunk piston engine lubricating oil compositions comprising Group I base oils and varying concentrations of dispersant additive was evaluated using a Black Sludge Deposit (BSD) Test as described in the test methods section.

Each of the 12 trunk piston engine lubricating oil compositions contained a mixture of two different Group I base oils, as illustrated in Table 2. Group I Base Oil #1 was ExxonMobil CORE® 600. Group I Base Oil #2 was ExxonMobil CORE® 2500. Group I Base Oil #3 was ExxonMobil CORE® 150.

Composition 1 contained no dispersant. The other 11 trunk piston engine lubricating oil compositions ("compositions 2-12") contained different concentrations of 3 different dispersants, as detailed in Table 2. Specifically, compositions 2-4 contained varying concentrations of a bissuccinimide dispersant derived from 1000 MW PIB and heavy polyamine/DETA (80/20 wt/wt) ("Dispersant A"); compositions 5-7 contained varying amounts of a borated bissuccinimide dispersant derived from 1300 MW PIB and heavy polyamine ("Dispersant B"); and compositions 8-12 contained varying concentrations of an ethylene carbonate-treated bissuccinimide dispersant derived from 2300 MW PIB and heavy polyamine ("Dispersant C").

Each of the 12 trunk piston engine lubricating oil compositions also contained 13.78 wt. % of a carboxylate-containing detergent additive, that was a mixture of: (a) 25.91 wt. % of a multi-surfactant unsulfurized, non-carbonated carboxylate-containing additive, prepared according to the method described in Example 1 of U.S. Patent Application Publication No. 2004/0235686; (b) 69.01 wt. % of an overbased calcium alkylhydroxybenzoate additive prepared according to the method described in Example 1 of U.S. Patent Application Publication No. 2007/0027043; and (c) 5.08 wt. % of an oil concentrate of a secondary zinc dialkyldithiophosphate.

The components of each of the 12 trunk piston engine lubricating oil compositions were blended to a viscosity of about 145 cSt at 40° C., a TBN of about 41, a phosphorus content of about 0.05 wt. %, and a Zinc content of about 0.058 wt. %.

The results of the BSD tests for each of the 12 trunk piston engine lubricating oil compositions, as well as a percentage comparison of the BSD test results for each of the trunk piston engine lubricating oil compositions to the BSD test results for composition 1, are set forth in Table 1. All weight percentages indicated in Table 1 are calculated based on the total weight of the trunk piston engine lubricating oil composition.

TABLE 1

BSD TEST RESULTS FOR GROUP I BASE-OIL CONTAINING COMPOSITIONS

| | Group I Base Oil (wt. %) | | | Dispersant (wt. %) | | | BSD Test Results | |
|---|---|---|---|---|---|---|---|---|
| Comp. # | #1 | #2 | #3 | A | B | C | mg deposit | % diff. in mg deposit v. Comp. #1 |
| 1 | 79.26 | 6.96 | — | — | — | — | 19.2 | — |
| 2 | 80.22 | 5.5 | — | 0.3 | — | — | 7.6 | (60%) |
| 3 | 81.08 | 4.14 | — | 0.6 | — | — | 13.5 | (30%) |
| 4 | 81.99 | 2.73 | — | 0.9 | — | — | 20.5 | 7% |
| 5 | 80.22 | 5.5 | — | — | 0.27 | — | 6.9 | (64%) |
| 6 | 81.08 | 4.14 | — | — | 0.54 | — | 11.6 | (40%) |
| 7 | 81.99 | 2.73 | — | — | 0.81 | — | 20.2 | 5% |
| 8 | 80.22 | 5.5 | — | — | — | 0.26 | 5.4 | (72%) |
| 9 | 81.08 | 4.14 | — | — | — | 0.51 | 16.2 | (16%) |

TABLE 1-continued

BSD TEST RESULTS FOR GROUP I BASE-OIL CONTAINING COMPOSITIONS

| | Group I Base Oil (wt. %) | | | Dispersant (wt. %) | | | BSD Test Results | |
|---|---|---|---|---|---|---|---|---|
| Comp. # | #1 | #2 | #3 | A | B | C | mg deposit | % diff. in mg deposit v. Comp. #1 |
| 10 | 81.99 | 2.73 | — | — | — | 0.76 | 25.3 | 32% |
| 11 | 82.90 | 1.32 | — | — | — | 1.02 | 35.3 | 184% |
| 12 | 81.91 | — | 1.31 | — | — | 1.53 | 64.3 | 334% |

Parentheticals around percentages in the "% diff." column indicate percentage decreases, whereas a lack of parentheticals indicate percentage increases.

As is evident from the results illustrated in Table 1, trunk piston engine lubricating oil compositions containing Group I base oils and about 0.2 to about 0.6 wt. % of dispersant exhibited a substantial dispersancy effect and surprisingly less black sludge formation than either dispersant-free trunk piston engine lubricating oil compositions and those trunk piston engine lubricating oil compositions having more than 0.6 wt. % of dispersant.

Example 2

The degree of stability against oxidation-based viscosity increase was evaluated for each of the 12 trunk piston engine lubricating oil compositions evaluated in Example 1 using a Modified Institute of Petroleum 48 ("MIP 48") test as described in the test methods.

The results of the MIP 48 tests for each of the 12 trunk piston engine lubricating oil compositions, as well as a percentage comparison of the MIP 48 test results for each of the trunk piston engine lubricating oil compositions to the MIP 48 test results for composition 1, are set forth in Table 2.

TABLE 2

MIP 48 TEST RESULTS FOR GROUP I BASE-OIL CONTAINING COMPOSITIONS

| Comp. | Group I Base Oil (wt. %) | | | Dispersant (wt. %) | | | MIP 48 Test Results | |
|---|---|---|---|---|---|---|---|---|
| # | #1 | #2 | #3 | A | B | C | % viscosity increase | % diff. in percent viscosity increase v. Composition #1 |
| 1 | 79.26 | 6.96 | — | — | — | — | 45.3 | — |
| 2 | 80.22 | 5.5 | — | 0.3 | — | — | 20.9 | (54%) |
| 3 | 81.08 | 4.14 | — | 0.6 | — | — | 14.5 | (68%) |
| 4 | 81.99 | 2.73 | — | 0.9 | — | — | 28.5 | (27%) |
| 5 | 80.22 | 5.5 | — | — | 0.27 | — | 40.6 | (10%) |
| 6 | 81.08 | 4.14 | — | — | 0.54 | — | 20.0 | (56%) |
| 7 | 81.99 | 2.73 | — | — | 0.81 | — | 24.0 | (47%) |
| 8 | 80.22 | 5.5 | — | — | — | 0.26 | 37.5 | (17%) |
| 9 | 81.08 | 4.14 | — | — | — | 0.51 | 28.8 | (36%) |
| 10 | 81.99 | 2.73 | — | — | — | 0.76 | 8.8 | (81%) |
| 11 | 82.90 | 1.32 | — | — | — | 1.02 | 20.4 | (55%) |
| 12 | 81.91 | — | 1.31 | — | — | 1.53 | 22.3 | (51%) |

Parentheticals around percentages in the "% diff." column indicate percentage decreases, whereas a lack of parentheticals indicate percentage increases.

As is evident from the results illustrated in Table 2, trunk piston engine lubricating oil compositions containing Group I base oils and a low concentration of dispersant exhibited surprisingly better stability against oxidation-based viscosity increases than did lubricating oil composition having no dispersant.

Example 3

Comparative

The efficacy of 12 trunk piston engine lubricating oil compositions comprising Group II base oils and the same varying concentrations of dispersant oil concentrate as was used in Example 1 was evaluated using a BSD Test as described in the test methods section.

Each of the 12 trunk piston engine lubricating oil compositions contained approximately 80 wt. % of a Group II base oil, as illustrated in Table 3. The Group II Base Oil was Chevron 600R Group II base stock, available from Chevron Products Co. (San Ramon, Calif.).

Composition 1 contained no dispersant oil concentrate. The other 11 trunk piston engine lubricating oil compositions ("compositions 2-12") contained different concentrations of 3 different dispersants, as detailed in Table 3. Specifically, compositions 2-4 contained varying concentrations of a bis-succinimide dispersant derived from 1000 MW PIB and heavy polyamine/DETA (80/20 wt/wt) ("Dispersant A"); compositions 5-7 contained varying concentrations of a borated bissuccinimide dispersant derived from 1300 MW PIBSA and heavy polyamine ("Dispersant B"); and compositions 8-12 contained varying concentrations of a ethylene carbonate-treated bissuccinimide dispersant derived from 2300 MW PIBSA and heavy polyamine) ("Dispersant C").

Each of the 12 trunk piston engine lubricating oil compositions also contained 18.85-19.10 wt. % of a carboxylate-containing detergent additive that was a mixture of: (a) 64.7 wt % of a multi-surfactant unsulfurized, non-carbonated carboxylate-containing additive, prepared according to the method described in Example 1 of U.S. Patent Application Publication No. 2004/0235686; (b) 31.7 wt. % of an over-based calcium alkylhydroxybenzoate additive prepared according to the method described in Example 1 of U.S. Patent Application Publication No. 2007/0027043; and (c) 5.08 wt. % of an oil concentrate of a secondary zinc dialkyldithiophosphate. Moreover, all trunk piston engine lubricating oil compositions had a TBN of about 40.

The components of each of the trunk piston engine lubricating oil compositions had viscosities from 132-153 cSt at 40° C., with the exception of Compositions 11 and 12, which had viscosities of 165.6 and 193 cSt at 40° C., respectively.

All trunk piston engine lubricating oil compositions had a TBN in the finished oil of about 40, a phosphorous content of about 0.05 wt. %, and a Zinc content of about 0.058 wt. %.

The results of the BSD tests for each of the 12 trunk piston engine lubricating oil compositions, as well as a percentage comparison of the BSD test results for each of the trunk piston engine lubricating oil compositions to the BSD test results for composition 1, are set forth in Table 3. All weight percentages indicated in Table 3 are calculated based on the total weight of the trunk piston engine lubricating oil composition.

TABLE 3

BSD TEST RESULTS FOR GROUP II BASE-OIL CONTAINING COMPOSITIONS

| Comp. # | Group II Base Oil (wt. %) | Dispersant (wt. %) A | B | C | Black Sludge Test Results mg deposit | % diff. in mg deposit v. Comp. #13 |
|---|---|---|---|---|---|---|
| 13 | ≈80 | — | — | — | 5.1 | — |
| 14 | ≈80 | 0.3 | — | — | 9.4 | 184% |
| 15 | ≈80 | 0.6 | — | — | 16.1 | 316% |
| 16 | ≈80 | 0.9 | — | — | 31.2 | 612% |
| 17 | ≈80 | — | 0.27 | — | 6.6 | 129% |
| 18 | ≈80 | — | 0.54 | — | 12.4 | 243% |
| 19 | ≈80 | — | 0.81 | — | 22.9 | 449% |
| 20 | ≈80 | — | — | 0.26 | 6.0 | 118% |
| 21 | ≈80 | — | — | 0.51 | 8.8 | 173% |
| 22 | ≈80 | — | — | 0.76 | 21.5 | 422% |
| 23 | ≈80 | — | — | 1.02 | 32.9 | 645% |
| 24 | ≈80 | — | — | 1.53 | 72.7 | 1425% |

Unlike Example 1, trunk piston engine lubricating oil compositions having Group II base oils in combination with about 0.2 to about 0.6 wt. % of dispersant do not exhibit less black sludge formation than dispersant-free trunk piston engine lubricating oil compositions.

Test Methods

Black Sludge Deposit (BSD) Test

A sample of test oil was mixed with heavy fuel oil to form a test mixture. Each test mixture was pumped over a heated test plate for a specified period of time. After cooling and washing, test plates were dried and weighed. The weight of each steel test plate was determined, and the weight of the deposit remaining on the steel test plate was measured and recorded as the change in weight of the steel test plate.

Modified Institute of Petroleum 48 (MIP 48) Test

Two samples of test oil were heated for a specified period of time. Nitrogen was passed through one of the test samples while air was passed through the other. The samples were cooled and the viscosities of both samples was determined. The oxidation-based viscosity increase for each of the 12 trunk piston engine lubricating oil compositions was calculated by subtracting the kinematic viscosity at 100° C. for the nitrogen blown sample from the kinematic viscosity at 100° C. for the air blown sample, and dividing the subtraction product by the kinematic viscosity 100° C. for the nitrogen blown sample.

All publications and patent applications mentioned in this specification are herein incorporated by reference to the same extent as if each individual publication or patent application was specifically and individually indicated to be incorporated by reference.

It will be apparent to one of ordinary skill in the art that many changes and modification can be made to the disclosures presented herein without departing from the spirit or scope of the appended claims.

What is claimed is:

1. A trunk piston engine lubricating oil composition, comprising:

a) at least 80 wt % of one or more Group I base oils;

b) 0.2-0.6 wt. % of one or more dispersant additives, on an actives basis, comprising a polyisobutene derived bis-succinimide, a borated polyisobutene derived bis-succinimide, or an ethylene carbonate polyisobutene derived bis-succinimide; and c) a carboxylate-containing detergent additive mixture in an amount of about 13.78 wt. % comprising:

i) one or more unsulfurized, non-carbonated, non-overbased carboxylate containing detergents, comprising a non-overbased salt of a mixture of an alkyl-substituted hydroxybenzoic acid and an alkyl-substituted phenol; and ii) one or more overbased detergents comprising an overbased salt of an alkyl-substituted hydroxybenzoic acid, wherein greater than 95% of the alkyl groups are $C_{20}$ or greater;

iii) an antiwear agent comprising a zinc dialkyldithiophosphate;

wherein the trunk piston engine lubricating oil composition:

1) has a total base number in the range of from 30 to 50; and 2) has a phosphorus content of from 0.02 wt. % to 0.08 wt. %, based on the total weight of the trunk piston engine lubricating oil composition.

2. The trunk piston engine lubricating oil composition of claim 1, wherein the composition is a viscosity-stabilized trunk piston engine lubricating oil composition.

3. The trunk piston engine lubricating oil composition of claim 2, wherein the composition has at least 5% less oxidation-based viscosity increase, when compared to a dispersant-free lubricating oil composition.

4. The trunk piston engine lubricating oil composition of claim 1, wherein the greater than 95% of the alkyl groups in the one or more overbased detergents are residues of linear alpha-olefin having 20 or more carbon atoms.

5. The trunk piston engine lubricating oil composition of claim 1, wherein the carboxylate-containing detergent additive mixture comprises an alkaline earth metal salt, said alkaline metal earth selected from the group consisting of calcium, magnesium, and combinations and mixtures thereof.

6. The trunk piston engine lubricating oil composition of claim 1, wherein the trunk piston engine lubricating oil composition has a viscosity of 5.6-21.9 cSt at 100° C.

7. A method for making a trunk piston engine lubricating oil composition, comprising mixing:

a) at least 80 wt. % of one or more Group I base oils;

b) 0.2-0.6 wt. % of one or more dispersant additives, on an actives basis, comprising a polyisobutene derived bis-succinimide, a borated polyisobutene derived bis-succinimide, or an ethylene carbonate polyisobutene derived bis-succinimide; and c) a carboxylate-containing detergent additive mixture in an amount of about 13.78 wt. % comprising:

i) one or more unsulfurized, non-carbonated, non-overbased carboxylate containing detergents, comprising a non-overbased salt of a mixture of an alkyl-substituted hydroxybenzoic acid and an alkyl-substituted phenol; and ii) one or more overbased detergents comprising an overbased salt of an alkyl-substituted hydroxybenzoic acid, wherein greater than 95% of the alkyl groups are $C_{20}$ or greater;

iii) an antiwear agent comprising a zinc dialkyldithiophosphate;

wherein the trunk piston engine lubricating oil composition:

1) has a total base number in the range of from 30 to 50; and 2) has a phosphorus content of from 0.02 wt. % to 0.08 wt. %, based on the total weight of the trunk piston engine lubricating oil composition.

8. A method for reducing black sludge and deposit formation in an engine, comprising lubricating the engine with a trunk piston engine lubricating oil composition, comprising:

a) at least 80 wt. % of one or more Group I base oils;

b) 0.2-0.6 wt. % of one or more dispersant additives, on an actives basis, comprising a polyisobutene derived bis-succinimide, a borated polyisobutene derived bis-succinimide, or an ethylene carbonate polyisobutene derived bis-succinimide; and c) a carboxylate-containing detergent additive in an amount of about 13.78 wt. % mixture comprising:

i) one or more unsulfurized, non-carbonated, non-overbased carboxylate containing detergents, comprising a non-overbased salt of a mixture of an alkyl-substituted hydroxybenzoic acid and an alkyl-substituted phenol; and ii) one or more overbased detergents comprising an overbased salt of an alkyl-substituted hydroxybenzoic acid, wherein greater than 95% of the alkyl groups are $C_{20}$ or greater;

iii) an antiwear agent comprising a zinc dialkyldithiophosphate;

wherein the trunk piston engine lubricating oil composition:

1) has a total base number in the range of from 30 to 50; and 2) has a phosphorus content of from 0.02 wt. % to 0.08 wt. %, based on the total weight of the trunk piston engine lubricating oil composition.

9. A method for operating a trunk piston engine, comprising lubricating the trunk piston engine with a trunk piston engine lubricating oil composition comprising:

a) at least 80 wt. % of one or more Group I base oils;

b) 0.2-0.6 wt. % of one or more dispersant additives, on an actives basis, comprising a polyisobutene derived bis-succinimide, a borated polyisobutene derived bis-succinimide, or an ethylene carbonate polyisobutene derived bis-succinimide; and c) a carboxylate-containing detergent additive mixture in an amount of about 13.78 wt. % comprising:

i) one or more unsulfurized, non-carbonated, non-overbased carboxylate containing detergents, comprising a non-overbased salt of a mixture of an alkyl-substituted hydroxybenzoic acid and an alkyl-substituted phenol; and ii) one or more overbased detergents comprising an overbased salt of an alkyl-substituted hydroxybenzoic acid, wherein greater than 95% of the alkyl groups are $C_{20}$ or greater;

iii) an antiwear agent comprising a zinc dialkyldithiophosphate;

wherein the trunk piston engine lubricating oil composition:

1) has a total base number in the range of from 30 to 50; and 2) has a phosphorus content of from 0.02 wt. % to 0.08 wt. %, based on the total weight of the trunk piston engine lubricating oil composition.

* * * * *